US012662742B2

(12) United States Patent
Deng et al.

(10) Patent No.: US 12,662,742 B2
(45) Date of Patent: Jun. 23, 2026

(54) COMPACT PORTABLE OXYHYDROGEN GENERATOR

(71) Applicant: DALIAN INSTITUTE OF CHEMICAL PHYSICS, CHINESE ACADEMY OF SCIENCES, Dalian (CN)

(72) Inventors: Dehui Deng, Dalian (CN); Yanting Liu, Dalian (CN); Xin Bo, Dalian (CN); Yunmao Shu, Dalian (CN)

(73) Assignee: DALIAN INSTITUTE OF CHEMICAL PHYSICS, CHINESE ACADEMY OF SCIENCES, Dalian (CN)

( * ) Notice: Subject to any disclaimer, the term of this patent is extended or adjusted under 35 U.S.C. 154(b) by 529 days.

(21) Appl. No.: 18/255,326

(22) PCT Filed: Mar. 24, 2021

(86) PCT No.: PCT/CN2021/082624
§ 371 (c)(1),
(2) Date: May 31, 2023

(87) PCT Pub. No.: WO2022/126898
PCT Pub. Date: Jun. 23, 2022

(65) Prior Publication Data

US 2024/0026550 A1 Jan. 25, 2024

(30) Foreign Application Priority Data

Dec. 15, 2020 (CN) ..... 202011484914.1
Dec. 15, 2020 (CN) ..... 202023028737.4

(51) Int. Cl.
*C25B 9/00* (2021.01)
*C25B 1/044* (2021.01)
(Continued)

(52) U.S. Cl.
CPC ..... *C25B 1/044* (2021.01); *C25B 9/17* (2021.01); *C25B 15/023* (2021.01); *C25B 15/085* (2021.01)

(58) Field of Classification Search
CPC ..... C25B 1/044; C25B 15/085; C25B 9/17; C25B 15/023
See application file for complete search history.

(56) References Cited

U.S. PATENT DOCUMENTS

2019/0203367 A1 7/2019 Davis

FOREIGN PATENT DOCUMENTS

CN 2651266 Y 10/2004
CN 204841319 U 12/2015
(Continued)

OTHER PUBLICATIONS

Qu, Feng et al.; "Improvement of Electrolyzing Water Oxyhydrogen Generator", www. chinacaaa.com"Automation Application"; vol. 11; Jan. 25, 2015; ISSN:1674-778X; pp. 25-26 and 35.
(Continued)

*Primary Examiner* — Zulmariam Mendez
(74) *Attorney, Agent, or Firm* — NKL Law; Allen Xue

(57) ABSTRACT

A compact portable oxyhydrogen generator has a housing, an end cover fastened on the upper end of the housing for discharging gas, and a bottom cover fastened at the lower end of the housing. A battery module for supplying power, an electrolytic cell module for generating hydrogen/oxygen mixture, a water filtration cell for filtering moisture, and a multi-stage filter baffle for further filtering the gas are sequentially arranged in the housing from bottom to top. A flame retardant core is provided between the filter baffle at the top layer and a gas outlet provided in the end cover. The multi-stage filter baffle is provided according to requirements of a gas filtering index. Water is used as a reaction raw
(Continued)

material and an inorganic salt can be used as an electrolyte, such that a normal-pressure hydrogen/oxygen mixture may be to directly generated, and can be produced when needed.

7 Claims, 3 Drawing Sheets

(51) Int. Cl.

| | |
|---|---|
| ***C25B 9/17*** | (2021.01) |
| ***C25B 15/023*** | (2021.01) |
| ***C25B 15/08*** | (2006.01) |

(56) References Cited

FOREIGN PATENT DOCUMENTS

| | | | |
|---|---|---|---|
| CN | 207363781 | U | 5/2018 |
| CN | 210620953 | U | 5/2020 |
| CN | 210796652 | U | 6/2020 |
| KR | 20200060146 | A | 5/2020 |

OTHER PUBLICATIONS

Agbossou, Kodjo et al., "Electrolytic Hydrogen Based Renewable Energy System with Oxygen Recovery and Re-utilization", Renewable Energy, vol. 8, No. 29, Jul. 31, 2004; ISSN:0960-1481; pp. 1305-1318.

COMPACT PORTABLE OXYHYDROGEN GENERATOR

TECHNICAL FIELD

The present invention relates to the technical field of preparing hydrogen and oxygen, in particular to a compact portable oxyhydrogen generator.

BACKGROUND

It is well known that hydrogen and oxygen can be prepared by electrolyzing water in terms of electrochemical principle, and the gas produced can be widely used in the fields of electronics, machinery, chemical engineering and the like. Meanwhile, electrolysis of water can also directly produce oxyhydrogen suitable for human inhalation ($H_2/O_2$: 66.6%/33.3%), which is widely used in hydrogen medicine.

However, the existing hydrogen and oxygen generation instrument is large in volume and weight, and high in price, which is only suitable for use in specific medical institutions. With continuous increasing of family demand and portability requirements, the miniaturization and lightweight of the hydrogen and oxygen generation instrument have become urgent problems to be solved.

Therefore, based on the portability requirements, it is necessary to develop a portable oxyhydrogen generator with low cost, safety and reliability, and rapid popularization.

SUMMARY OF THE INVENTION

In order to solve the above technical problems, the present invention provides a compact portable oxyhydrogen generator. According to the present invention, a battery module for supplying power, an electrolytic cell module for generating hydrogen and oxygen, a water filtration cell for filtering moisture, and a multi-stage filter baffle for further filtering gas are sequentially arranged in the housing to make full use of the inner space of the housing, so as to efficiently prepare hydrogen/oxygen mixture, having the characteristics of low energy consumption, low cost, compact structure, portability, safety and noise free.

Technical solutions adopted by the present invention are as follows:

A compact portable oxyhydrogen generator includes a housing, an end cover fastened on an upper end of the housing discharging gas, and a bottom cover fastened at an lower end of the housing, where a battery module for supplying power, an electrolytic cell module for generating hydrogen/oxygen mixture, a water filtration cell for filtering moisture, and a multi-stage filter baffle for further filtering the gas are sequentially arranged in the housing from bottom to top. A flame retardant core is provided between the filter baffle at the top layer and a gas outlet provided in the end cover, and the multi-stage filter baffle is provided according to requirements of a gas filtering index.

Further, a water level monitoring module is further provided between the electrolytic cell module and the water filtration cell, and the water level monitoring module includes a high water level indicator and a low water level floating ball connected with a sensor.

Further, the multi-stage filter baffle is provided with at least two stages of filter baffles.

Further, the water filtration cell cooperates with the end cover to lock tightly, an accommodating cavity for containing the multi-stage filter baffle is formed between the two, a middle of the water filtration cell is provided with a hollow raised portion, a middle part of the multi-stage filter baffle is provided with a centered indentation, a middle part of the raised portion is pressed against the adjacent side centered indentation of the first-stage filter baffle of the multi-stage filter baffle, and is sealed with the middle part and the periphery of the first-stage filter baffle.

Further, the two adjacent filter baffles have the same or different structural forms.

Further, the structure of the multi-stage filter baffle is a disc structure with a centered indentation corresponding to the raised portion of the water filtration cell in the middle, a disc main body thereof is provided with at least one through hole for the hydrogen/oxygen mixture to pass through, and a lower end of the disc main body is selectively provided with a plurality of auxiliary baffles.

Further, the structure of the multi-stage filter baffle is a screen-type disc composite structure with a plurality of air holes, where a top layer disc has a plurality of air holes and each of other discs has at least one main air hole, and a plurality of discs is staggered arrangement to form a filter structure.

Further, at least one electrode for reaction is provided in the electrolytic cell. When there are more than two electrodes, adjacent electrodes are separated by an insulating ring.

Further, a sealing ring is further arranged between the water filtration cell and the end cover and the housing.

Further, a lower end of the bottom cover is provided with a non-slip pad.

Compared with the prior art, the present invention has the following advantages:

The present invention uses water as the reaction raw material and a cheap inorganic salt as the electrolyte, so that a normal-pressure hydrogen/oxygen mixture may be directly produced, and can be produced when needed. The present solution is high in safety and has characteristics such as small volume, light weight, low energy consumption, low cost, safe and noise free, and is simple in structure, high in practicability, and is portable.

DETAILED DESCRIPTION OF DRAWINGS

In order to more clearly illustrate technical solutions in the embodiments of the present disclosure or in the prior art, a brief introduction to the accompanying drawings required for the description of the embodiments or the prior art will be provided below. Obviously, the accompanying drawings in the following description are some of the embodiments of the present disclosure, and those ordinary skilled in the art would also be able to derive other drawings from these drawings without making creative efforts.

Figure 1:
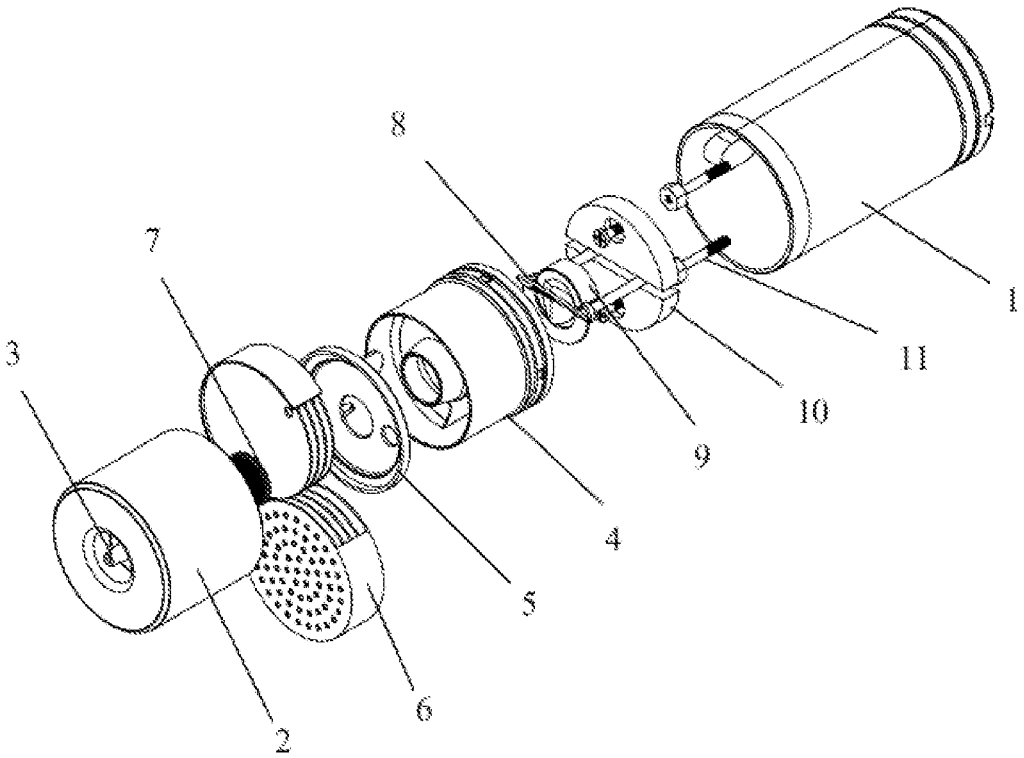
FIG. 1 is an exploded structural diagram of compact portable oxyhydrogen generator of the present invention shown in Embodiment 1.

In the figures, 1. housing; 2. end cover; 3. gas outlet; 4. water filtration cell; 5. first-stage filter baffle; 6. second-stage filter baffle; 7. flame retardant core; 8. high water lever indicator; 9. low water floating ball; 10. electrode; 11. screw rob; 12. reinforcement electrode; 13. insulating ring; 14. battery; 15. bottom cover; 16. third-stage filter baffle; 17. sealing ring; 18. non-slip pad; 19. power button; 20. gasket; 21. screw; 22. power connector.

DETAILED DESCRIPTION OF PREFERRED EMBODIMENTS

It should be noted that, in the case of no conflicts, the embodiments and the features in the embodiments of the present invention can be combined mutually. The present invention will be described in detail below with reference to the accompanying drawings and the embodiments.

To make the objectives, technical solutions and advantages of embodiments of the present disclosure more obvious, the technical solutions of the present disclosure will be clearly and completely described below in conjunction with the accompanying drawings in the embodiments of the present disclosure, and obviously, the described embodiments are some, rather than all of the embodiments of the present disclosure. The following description of at least one example embodiment is merely illustrative in nature, and is in no way intended to limit the present disclosure, an application or use thereof. Based on the embodiments of the present disclosure, all other embodiments acquired by those ordinary skilled in the art without making creative efforts fall within the scope of protection of the present disclosure.

It should be noted that the terms used herein are only intended to describe specific embodiments and are not intended to limit the example embodiments of the present disclosure. As used herein, unless indicated obviously in the context, a singular form is also intended to include a plural form. In addition, it should also be understood that the terms "include" and/or "comprise" used in this specification indicate features, steps, operations, devices, components and/or their combinations.

Except as otherwise specifically set forth, the relative arrangement of components and steps, numerical expressions and numerical values set forth in these embodiments do not limit the scope of the present invention. In addition, it should be clear that, for ease of description, sizes of the various components shown in the accompanying drawings are not drawn according to actual proportional relationships. Technologies, methods, and devices known to those of ordinary skill in the relevant fields may not be discussed in detail, but where appropriate, the technologies, methods, and devices should be considered as a part of the authorization specification. In all the examples shown and discussed herein, any specific value should be interpreted as merely example rather than limiting. Therefore, other examples of the example embodiments may have different values. It should be noted that similar reference signs and letters represent similar items in the accompanying drawings below. Therefore, once an item is defined in one accompanying drawing, the item does not need to be further discussed in a subsequent accompanying drawing.

In the description of the present invention, it should be noted that orientations or position relationships indicated by orientation terms "front, rear, upper, lower, left, and right", "transverse, vertical, perpendicular, and horizontal", "top and bottom", and the like are usually based on orientations or position relationships shown in the accompanying drawings, and these terms are only used to facilitate description of the present invention and simplification of the description. In the absence of description to the contrary, these orientation terms do not indicate or imply that the apparatus or element referred to must have a specific orientation or be constructed and operated in a specific orientation, and therefore cannot be understood as a limitation on the protection scope of the present invention: orientation words "inner and outer" refer to the inside and outside relative to the contour of each component.

For ease of description, spatially relative terms such as "on", "over", "on the upper surface", and "above" can be used here, to describe a spatial positional relationship between one device or feature and another device or feature shown in the figures. It should be understood that the spatially relative terms are intended to include different orientations in use or operation other than the orientation of the device described in the figure. For example, if the device in the figure is inverted, the device described as "above another device or structure" or "on another device or structure" is then be positioned as being "below another device or structure" or "beneath a device or structure". Therefore, the exemplary term "above" can include both orientations "above" and "below". The device can also be positioned in other different ways (rotating by 90 degrees or in another orientation), and the spatially relative description used herein is explained accordingly.

In addition, it should be noted that using terms such as "first-stage" and "second-stage" to define components is only for the convenience of distinguishing the corresponding components. Unless otherwise stated, the foregoing words have no special meaning and therefore cannot be understood as a limitation on the protection scope of the present invention.

Embodiment 1

Figure 2:
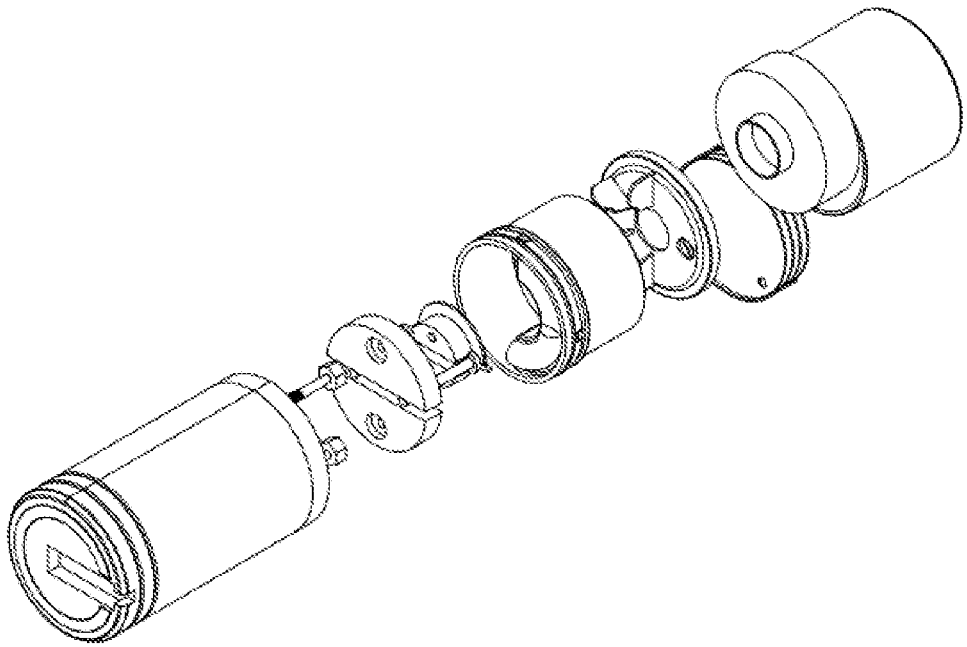
FIG. 2 is a rear view exploded structure diagram of compact portable oxyhydrogen generator of the present invention shown in Embodiment 1.

As shown in FIGS. 1 and 2, provided is a compact portable oxyhydrogen generator, including a housing 1, an end cover 2 fastened on an upper end of the housing 1 for discharging gas, and a bottom cover 15 fastened on an upper end of the housing 1.

A battery module for supplying power, an electrolytic cell module for generating hydrogen/oxygen mixture, a water filtration cell 4 for filtering moisture, and a multi-stage filter baffle for further filtering the gas are sequentially arranged in the housing 1 from bottom to top. As shown in the figures, the multi-stage filter baffle has two stages. The first-stage filter baffle 5 is adjacent to the water filtration cell 4, and a flame retardant core 7 is provided between the second-stage filter baffle 6 and the gas outlet 3 arranged in the end cover 2.

A water level monitoring module is further provided between the electrolytic cell module and the water filtration cell 4, and the water level monitoring module includes a high water level indicator 8 and a low water level floating ball 9 connected with a sensor. The water level monitoring module is arranged on the electrode 10 to monitor the addition amount and usage amount of the electrolyte.

The water filtration cell 4 cooperates with the end cover 2 to lock tightly through threads, and an accommodating cavity for containing the multi-stage filter baffle is formed therebetween. Specifically, the water filtration cell 4 is used for holding water, and the middle of the water filtration cell 4 is provided with a hollow raised portion. The structure of the first-stage filter baffle 5 is a disc structure with a centered indentation corresponding to the raised portion of the water filtration cell 4 in the middle part, and the middle part is an indentation structure without hollow opening; and the periphery of disc is provided with a slightly raised outer edge, the disc main body thereof (not the middle position) is provided with at least one through hole for the hydrogen/ oxygen mixture to pass through, and the lower end of the disc main body is selectively provided with a plurality of auxiliary baffles. The auxiliary baffles may be seen from the back view of FIG. 2.

The middle part of the raised portion is pressed against the centered indentation of the first-stage filter baffle 5 and is sealed with the middle part and the periphery of the first-stage filter baffle 5, ensuring that the gas generated by the reaction passes through the water cell of the water filtration cell 4 and then is filtered layer by layer through the air passage beside the water filtration cell 4.

The second-stage filter baffle 6 has the same or different structure with the first-stage filter baffle 5. The structure of the second-stage filter baffle 6 is a screen-type disc composite structure with a plurality of air holes, and the top layer disc is a screen with a plurality of air holes, and each of other discs has at least one main air hole. A plurality of discs is staggered arrangement to form a filter structure. As shown in the figures, the second-stage filter baffle 6 is a composite structure with two parts inlaid and closed together; and the hydrogen/oxygen mixture with water vapor condenses water vapor through the layers of filter baffles, thereby making the gas discharged from the gas outlet more dry.

In the embodiment, the electrolytic cell module is provided with an electrode 10 for reaction, and the electrode is tightly screwed with the fixed hole on the bottom cover 15 by the screw robs 11 passing through the baffles between the electrolytic cell module and the battery module.

Embodiment 2

Figure 3:
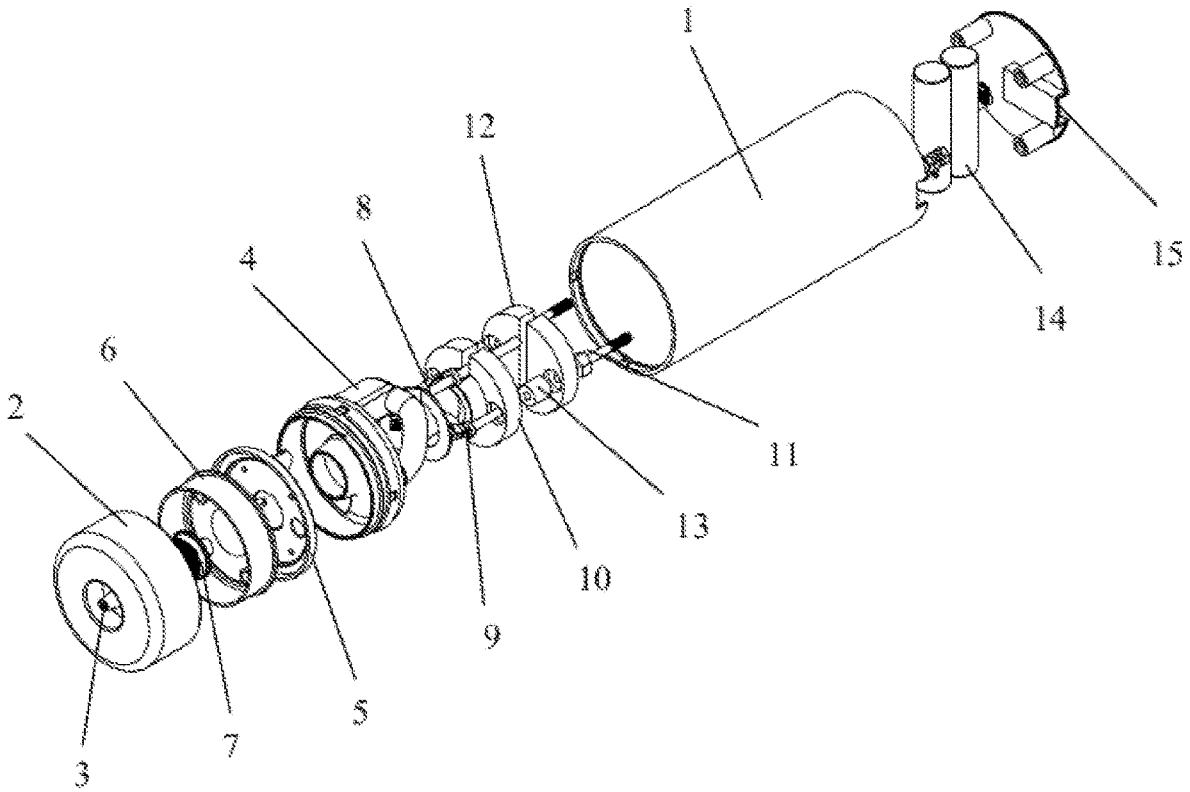
FIG. 3 is an exploded structural diagram of compact portable oxyhydrogen generator of the present invention shown in Embodiment 2.

As shown in FIG. 3, different from Embodiment 1, in this embodiment, two electrodes structure are provided. In order to improve the reaction rate, the electrode 10 and the reinforcement electrode 12 are used in cooperation, and the two electrodes are separated by the insulating ring 13 between the two.

In addition, the water filtration cell 4 in this embodiment can clearly see a large accommodating cavity for water storage and a gas pipe connected to the large accommodating cavity, prolonging the circulation route of the reaction gas and making the filtration more sufficient. Similarly, the second-stage filter baffle 6 adopts a side hole-shaped structure staggered with the first-stage filter baffle 5.

Embodiment 3

Figure 4:
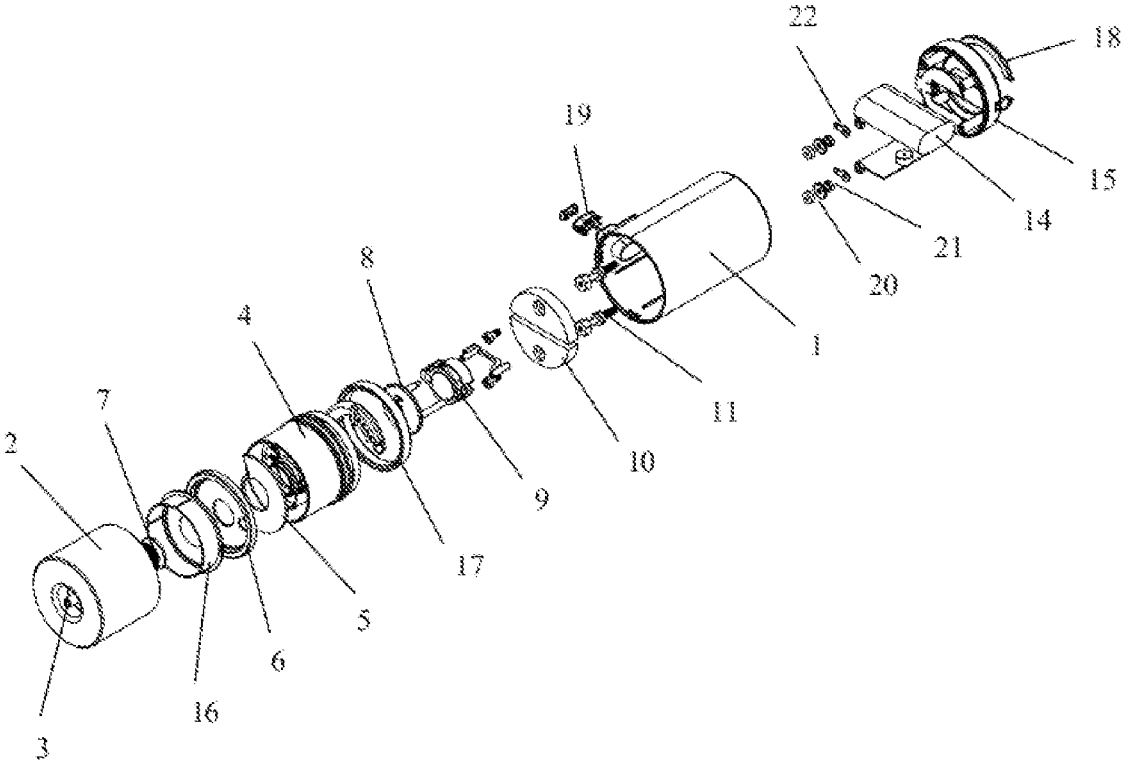
FIG. 4 is an exploded structural diagram of compact portable oxyhydrogen generator of the present invention shown in Embodiment 3.

As shown in FIG. 4, different from Embodiment 1, in this embodiment, the first-stage filter baffle 5 is a plate-shaped filter baffle with a ventilation portion on one side, the second-stage filter baffle 6 has a structure generally identical to Embodiment 1. In this embodiment, a third-stage filter baffle 16 is further provided, and water vapor of the hydrogen/oxygen mixture is removed through condensation layer by layer. A sealing ring 17 is further provided between the water filtration cell 4, the end cover 2 and the housing 1. When the end cover 2 and the water filtration cell 4 are tightly locked, the sealing ring 17 plays a sealing effect.

When in use, water and electrolyte can be introduced from the gas outlet 3, and then the water level monitoring module can monitor whether the water level in the electrolytic cell is appropriate. The power connector 22 is in contact with the battery 14, the circuit board is turned on through the power button 19 to control the whole device, and the electrode 10 starts to react and produce gas in the electrolyte module. The electrode 10 is fixed to the bottom cover 15 by the screw robs 11 passing through the gaskets 20 and the screws in turn. In order to be placed upright on the table top and other positions, the lower end of the bottom cover 15 is provided with a non-slip pad 18.

The power button 19 is turned on, and the oxyhydrogen generator is started to produce gas. The hydrogen/oxygen mixture mixed with water vapor is produced in the electrolytic cell module and enters the water filtration cell 4, and enters the multi-stage filter baffle through the air passage. The water vapor condenses on the filter baffles and falls back into the electrolytic cell through the winding ventilation air passage formed among the multistage filter baffles, and the relatively dry hydrogen/oxygen mixture is finally exported from the gas outlet 3 through the flame retardant core 7 for a user to inhale.

At last, it should be noted that the above various embodiments are merely intended to illustrate the technical solution of the present disclosure and not to limit the same; although the present disclosure has been described in detail with reference to the foregoing embodiments, it should be understood by those ordinary skilled in the art that the technical solutions described in the foregoing embodiments can be modified or equivalents can be substituted for some or all of the technical features thereof; and the modification or substitution does not make the essence of the corresponding technical solution deviate from the scope of the technical solution of each embodiment of the present disclosure.

The invention claimed is:

1. A compact portable oxyhydrogen generator, comprising a housing, an end cover fastened to an upper end of the housing for discharging gas, and a bottom cover fastened to a lower end of the housing, wherein a battery module for supplying power, an electrolytic cell module for generating a gas mixture comprising hydrogen and oxygen, a water filtration cell for filtering water in the gas mixture from the electrolytic cell module, and a multi-stage filter for further filtering water in the gas mixture from the water filtration cell are sequentially arranged in the housing from bottom to top, wherein a flame retardant core is provided between the multi-stage filter and a gas outlet disposed in the end cover, wherein the multi-stage filter comprises at least a first-stage baffle and a second-stage baffle, the multi-stage filter is disposed in a cavity formed between the end cover and the water filtration cell, and a middle part of the water filtration cell is provided with a hollow raised portion, the first-stage baffle is a disc having through hole in the center thereof connected to the hollow raised portion in the water filtration cell, and a side of the disc facing the water filtration cell is provided with a plurality of auxiliary baffles, wherein the second-stage filter baffle has a plurality of perforated disc with a plurality of air holes, and the plurality of perforated discs are staggered to form a filter structure, and wherein the hollow raised portion in the water filtration cell, the through hole in the first-stage baffle, the plurality of air holes in the second-stage baffle, and the gas outlet in the end cover form a passage for the gas mixture.

2. The compact portable oxyhydrogen generator according to claim 1, further comprising a water level monitoring module provided between the electrolytic cell module and the water filtration cell, and the water level monitoring module comprises a high water level indicator and a low water level floating ball connected with a sensor.

3. The compact portable oxyhydrogen generator according to claim 1, wherein the multi-stage filter comprises a third-stage filter baffle.

4. The compact portable oxyhydrogen generator according to claim 1, wherein the electrolytic cell module has at least one electrode.

5. The compact portable oxyhydrogen generator according to claim 1, wherein a sealing ring is further arranged between the water filtration cell and the end cover of the housing.

6. The compact portable oxyhydrogen generator according to claim 1, wherein a lower end of the bottom cover is provided with a non-slip pad.

7. The compact portable oxyhydrogen generator according to claim 4, wherein the electrolytic cell module comprises more than two electrodes, and adjacent electrodes are separated by an insulating ring.

* * * * *